US011828510B2

(12) United States Patent
Tomiyama

(10) Patent No.: US 11,828,510 B2
(45) Date of Patent: Nov. 28, 2023

(54) REFRIGERATION APPARATUS

(71) Applicant: DAIKIN INDUSTRIES, LTD., Osaka (JP)

(72) Inventor: You Tomiyama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/709,842

(22) Filed: Mar. 31, 2022

(65) Prior Publication Data

US 2022/0221210 A1 Jul. 14, 2022

Related U.S. Application Data

(63) Continuation of application No. PCT/JP2020/039918, filed on Oct. 23, 2020.

(30) Foreign Application Priority Data

Oct. 31, 2019 (JP) ..... 2019-199258

(51) Int. Cl.
*F25B 49/02* (2006.01)
*F25B 13/00* (2006.01)
*F25B 43/02* (2006.01)

(52) U.S. Cl.
CPC ..... *F25B 49/022* (2013.01); *F25B 13/00* (2013.01); *F25B 43/02* (2013.01)

(58) Field of Classification Search
CPC ..... F25B 49/022; F25B 13/00; F25B 1/00; F25B 43/00; F25B 49/02
See application file for complete search history.

(56) References Cited

U.S. PATENT DOCUMENTS

2014/0360223 A1* 12/2014 Setoguchi ..... F25B 43/00 62/509
2018/0003419 A1* 1/2018 Ohura ..... F24F 11/89
2018/0023868 A1 1/2018 Ishiyama et al.

FOREIGN PATENT DOCUMENTS

CN 107429949 A 12/2017
CN 109059211 A * 12/2018
JP S6213952 A * 1/1987
(Continued)

OTHER PUBLICATIONS

Akuto et al., Refrigeration Cycle System, Outdoor Unit, and Control Unit, Dec. 20, 2018, JP2018200137A, Whole Document (Year: 2018).*

(Continued)

*Primary Examiner* — Larry L Furdge
(74) *Attorney, Agent, or Firm* — Birch, Stewart, Kolasch & Birch, LLP

(57) ABSTRACT

An air conditioning apparatus includes a refrigerant circuit, a suction temperature sensor, and a controller. In the refrigerant circuit, a compressor, a radiator, an expansion valve, an evaporator, and an accumulator are connected in order. The controller controls the number of revolutions of the compressor and the opening degree of the expansion valve. On determination that a refrigerant and a lubricating oil are separated inside the accumulator based on a detection result of the suction temperature sensor, the controller executes control of step to decrease the number of revolutions of the (Continued)

compressor, and executes control of step to set the opening degree of the expansion valve to a predetermined opening degree.

22 Claims, 5 Drawing Sheets

(56) References Cited

FOREIGN PATENT DOCUMENTS

| | | | | |
|---|---|---|---|---|
| JP | 9-21569 | A | | 1/1997 |
| JP | 2000-18739 | A | | 1/2000 |
| JP | 2000018739 | A | * | 1/2000 |
| JP | 2002-221369 | A | | 8/2002 |
| JP | 200326418 | A | * | 9/2003 |
| JP | 2013-228115 | A | | 11/2013 |
| JP | 2015-64128 | A | | 4/2015 |
| JP | 2015-92123 | A | | 5/2015 |
| JP | 2016-211774 | A | | 12/2016 |
| JP | 2017-198376 | A | | 11/2017 |
| JP | 2018200137 | A | * | 12/2018 |
| WO | WO 2019/087401 | A1 | | 5/2019 |

OTHER PUBLICATIONS

Marumoto et al., Heating Cooling Combination Device, Jan. 18, 2000, JP2000018739A, Whole Document (Year: 2000).*

Unezaki et al., Refrigerating Air Conditioner, Sep. 19, 2003, JP2003262418A, Whole Document (Year: 2003).*

MengJiao, Frequency Conversion System Shutdown Control Method with Enhanced Vapor Injection and Controller, Dec. 21, 2018, CN109059211A, Whole Document (Year: 2018).*

Kozo et al., Air Conditioner, Jan. 22, 1987, JPS6213952A, Whole Document (Year: 1987).*

International Search Report, issued in PCT/JP2020/039918, PCT/ISA/210, dated Dec. 28, 2020.

Written Opinion of the International Searching Authority, issued in PCT/JP2020/039918, PCT/ISA/237, dated Dec. 28, 2020.

English translation of the International Preliminary Report on Patentability and Written Opinion of the International Searching Authority for International Application No. PCT/JP2020/039918, dated May 12, 2022.

Extended European Search Report for European Application No. 20883120.6, dated Nov. 9, 2022.

* cited by examiner

RELATIONSHIP BETWEEN OIL CONCENTRATION AND TWO-LAYER SEPARATION TEMPERATURE (R32/FW68D)

REFRIGERATION APPARATUS

CROSS REFERENCE TO RELATED APPLICATIONS

This application is a Continuation of PCT International Application No. PCT/JP2020/039918, filed on Oct. 23, 2020, which claims priority under 35 U.S.C. 119(a) to Patent Application No. 2019-199258, filed in Japan on Oct. 31, 2019, all of which are hereby expressly incorporated by reference into the present application.

TECHNICAL FIELD

The present disclosure relates to a refrigeration apparatus, in particular to a refrigeration apparatus in which a container is disposed between an evaporator and a compressor.

BACKGROUND ART

Conventionally, there has been a refrigeration apparatus including a container that temporarily stores a refrigerant returning from an evaporator to a compressor. Refrigerating machine oil is sealed in a refrigerant circuit of the refrigeration apparatus together with the refrigerant, and the refrigerant and the refrigerating machine oil may separate in the container depending on temperature and pressure conditions. For this problem, Patent Literature 1 (Japanese Laid-Open Patent Publication No. 2016-211774) discloses an apparatus that executes an operation of stirring the separated refrigerant and refrigerating machine oil to solve the separation state.

SUMMARY

A refrigeration apparatus of a first aspect includes a refrigerant circuit, a detection unit, and a control unit. In the refrigerant circuit, a compressor, a radiator, an expansion valve, an evaporator, and a container are connected in order. The refrigerant flows inside the refrigerant circuit. The detection unit detects the temperature or pressure of the refrigerant. The control unit controls the number of revolutions of the compressor and the opening degree of the expansion valve. On determination that the refrigerant and a lubricating oil are separated inside the container based on a detection result of the detection unit, the control unit executes first control and second control. The first control is control to decrease the number of revolutions of the compressor. The second control sets the opening degree of the expansion valve to a predetermined opening degree.

DESCRIPTION OF EMBODIMENT

Hereinafter, an air conditioning apparatus as a refrigeration apparatus will be described with reference to the drawings.

(1) Overall Configuration

Figure 1:
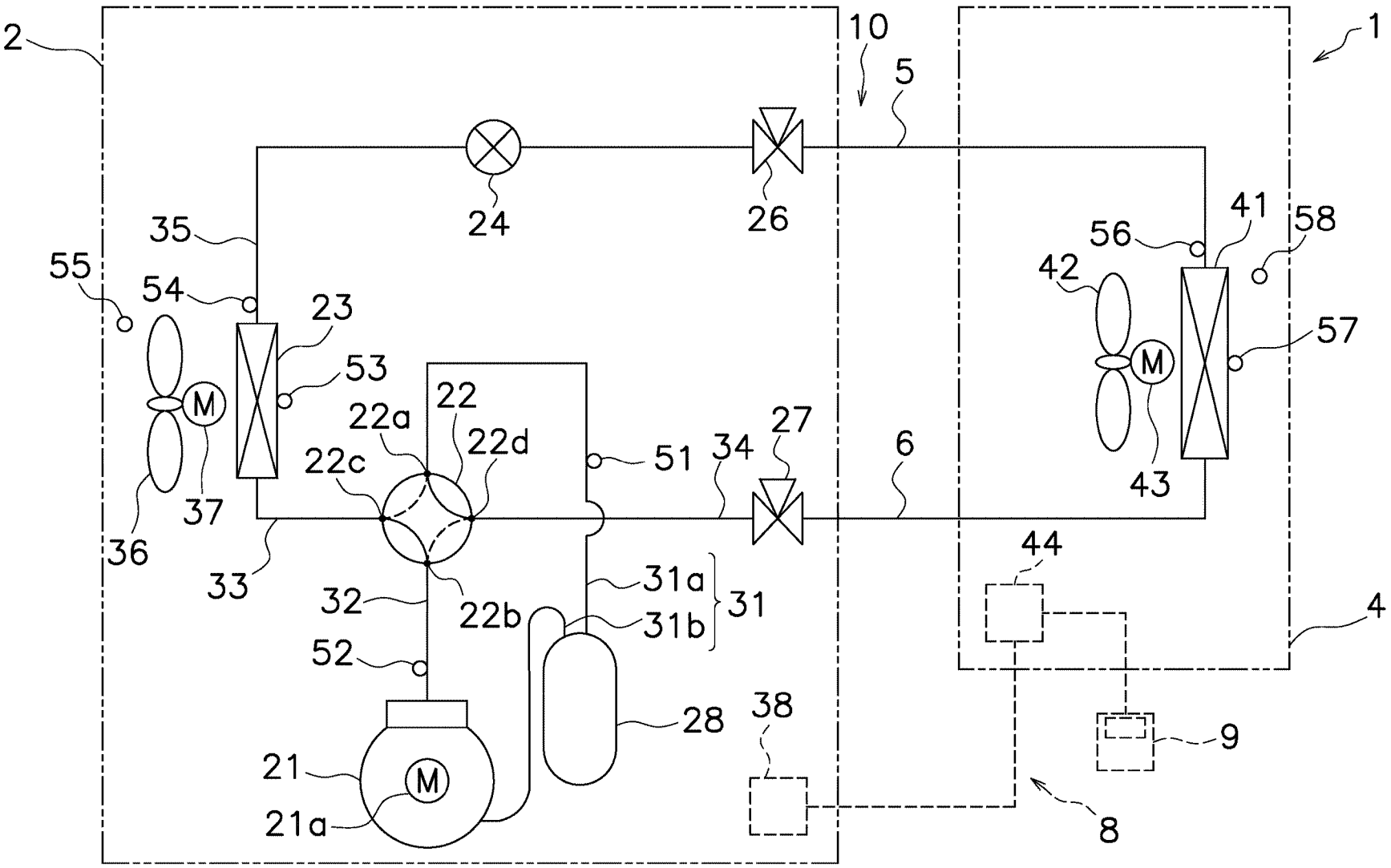
FIG. 1 is a schematic configuration diagram of an air conditioning apparatus.

FIG. 1 is a schematic configuration diagram of an air conditioning apparatus 1 (refrigeration apparatus). The air conditioning apparatus 1 is an apparatus capable of cooling and heating a room of a building or the like by a vapor compression refrigeration cycle. The air conditioning apparatus 1 includes an outdoor unit 2 and an indoor unit 4. The outdoor unit 2 and the indoor unit 4 are connected via a liquid-refrigerant connection pipe 5 and a gas-refrigerant connection pipe 6. A refrigerant circuit 10 that constitutes the vapor compression refrigeration cycle of the air conditioning apparatus 1 is configured by the outdoor unit 2 and the indoor unit 4 being connected via the refrigerant connection pipes 5 and 6. Difluoromethane (R32), which is a refrigerant, is charged in the refrigerant circuit 10. Refrigerating machine oil, which is immiscible with the refrigerant, is also charged in the refrigerant circuit 10 together with the refrigerant.

(2) Detailed Configuration (2-1) Indoor Unit

The indoor unit 4 is installed indoors and constitutes part of the refrigerant circuit 10. The indoor unit 4 includes an indoor heat exchanger 41.

In a cooling operation, the indoor heat exchanger 41 functions as an evaporator for a refrigerant to cool indoor air, and in a heating operation, the indoor heat exchanger 41 functions as a radiator for a refrigerant to heat indoor air. A first end of the indoor heat exchanger 41 is connected to the liquid-refrigerant connection pipe 5. A second end of the indoor heat exchanger 41 is connected to the gas-refrigerant connection pipe 6.

The indoor unit 4 includes an indoor fan 42. The indoor fan 42 sucks indoor air into the indoor unit 4, exchanges heat with the refrigerant in the indoor heat exchanger 41, and then supplies the air indoors as supply air. The indoor fan 42 is, for example, a centrifugal fan, a multi-blade fan, or the like driven by an indoor fan motor 43. The indoor fan motor 43 can change a frequency (number of revolutions) by an inverter.

The indoor unit 4 includes various sensors. The indoor unit 4 includes a liquid pipe temperature sensor 56, an intermediate temperature sensor 57, and an indoor temperature sensor 58. The liquid pipe temperature sensor 56 detects a temperature Trl of the refrigerant in the liquid side refrigerant pipe of the indoor heat exchanger 41. The intermediate temperature sensor 57 detects a temperature Trm of the refrigerant in an intermediate portion of the indoor heat exchanger 41. The indoor temperature sensor 58 detects a temperature Tra of the indoor air sucked into the indoor unit 4.

(2-2) Outdoor Unit

The outdoor unit 2 is installed outdoors and constitutes part of the refrigerant circuit 10. The outdoor unit 2 includes a compressor 21, a four-way switching valve 22, an outdoor heat exchanger 23, an expansion valve 24, a liquid-side shutoff valve 26, a gas-side shutoff valve 27, and an accumulator 28. The outdoor unit 2 includes an outdoor fan 36.

(2-2-1) Compressor

The compressor 21 compresses a low-pressure refrigerant in the refrigeration cycle until the refrigerant turns into a high-pressure refrigerant. The compressor 21 drives a positive-displacement compression element (not shown), such as a rotary type or scroll type, to rotate by a compressor motor 21*a*. Here, as the compressor 21, a rotary compressor with closed structure is used. The compressor motor 21*a* can change a frequency (number of revolutions) by an inverter. A suction pipe 31 is connected to a suction side of the compressor 21, and a discharge pipe 32 is connected to a discharge side. The suction pipe 31 connects the suction side of the compressor 21 to a first port 22*a* of the four-way switching valve 22. The suction pipe 31 is provided with the accumulator 28. The suction pipe 31 is divided into a first pipe 31*a* and a second pipe 31*b* before and after the accumulator 28. The accumulator 28 is a container that temporarily stores the refrigerant sucked into the compressor 21. The accumulator 28 will be described in detail later with reference to FIG. 2. The discharge pipe 32 is a refrigerant pipe connecting the discharge side of the compressor 21 to a second port 22*b* of the four-way switching valve 22.

(2-2-2) Four-Way Switching Valve

The four-way switching valve 22 switches a refrigerant flow direction in the refrigerant circuit 10.

When starting the cooling operation, the four-way switching valve 22 switches to the cooling cycle state in which the outdoor heat exchanger 23 functions as a radiator for the refrigerant compressed in the compressor 21, and the indoor heat exchanger 41 functions as an evaporator for the refrigerant that has radiated heat in the outdoor heat exchanger 23. When starting the cooling operation, the four-way switching valve 22 switches such that the second port 22*b* and a third port 22*c* communicate with each other, and the first port 22*a* and a fourth port 22*d* communicate with each other. Accordingly, the discharge side of the compressor 21 (discharge pipe 32) is connected to a gas side of the outdoor heat exchanger 23 (first gas refrigerant pipe 33) (see the solid line in the four-way switching valve 22 in FIG. 1). Furthermore, the suction side of the compressor 21 (suction pipe 31) is connected to the gas-refrigerant connection pipe 6 side (second gas refrigerant pipe 34) (see the solid line in the four-way switching valve 22 in FIG. 1).

When starting the heating operation, the four-way switching valve 22 switches to the heating cycle state in which the outdoor heat exchanger 23 functions as an evaporator for the refrigerant that has radiated heat in the indoor heat exchanger 41, and the indoor heat exchanger 41 functions as a radiator for the refrigerant compressed in the compressor 21. When starting the heating operation, the four-way switching valve 22 switches such that the second port 22*b* and the fourth port 22*d* communicate with each other, and the first port 22*a* and the third port 22*c* communicate with each other. Accordingly, the discharge side of the compressor 21 (discharge pipe 32) is connected to the gas-refrigerant connection pipe 6 side (second gas refrigerant pipe 34) (see the broken line in the four-way switching valve 22 in FIG. 1). Furthermore, the suction side of the compressor 21 (suction pipe 31) is connected to the gas side of the outdoor heat exchanger 23 (first gas refrigerant pipe 33) (see the broken line in the four-way switching valve 22 in FIG. 1). The first gas refrigerant pipe 33 is a refrigerant pipe that connects the third port 22*c* of the four-way switching valve 22 to the gas side of the outdoor heat exchanger 23. The second gas refrigerant pipe 34 is a refrigerant pipe that connects the fourth port 22*d* of the four-way switching valve 22 to the gas-refrigerant connection pipe 6 side.

(2-2-3) Outdoor Heat Exchanger

In the cooling operation, the outdoor heat exchanger 23 functions as a radiator for the refrigerant whose cooling source is outdoor air. In the heating operation, the outdoor heat exchanger 23 functions as an evaporator for the refrigerant whose heating source is outdoor air. A first end on the liquid side of the outdoor heat exchanger 23 is connected to a liquid refrigerant pipe 35, and a second end on the gas side is connected to the first gas refrigerant pipe 33. The liquid refrigerant pipe 35 is a refrigerant pipe that connects the first end on the liquid side of the outdoor heat exchanger 23 to the liquid-refrigerant connection pipe 5.

(2-2-4) Expansion Valve

In the cooling operation, the expansion valve 24 decompresses the high-pressure refrigerant that has radiated heat in the outdoor heat exchanger 23 in the refrigeration cycle to low pressure in the refrigeration cycle. In the heating operation, the expansion valve 24 decompresses the high-pressure refrigerant that has radiated heat in the indoor heat exchanger 41 in the refrigeration cycle to low pressure in the refrigeration cycle. The expansion valve 24 is provided in the liquid refrigerant pipe 35. The expansion valve 24 is an electric expansion valve with a changeable opening degree.

(2-2-5) Liquid-Side Shutoff Valve and Gas-Side Shutoff Valve

The liquid-side shutoff valve 26 and the gas-side shutoff valve 27 are provided in connecting ports with external devices and pipes (specifically, liquid-refrigerant connection pipe 5 and gas-refrigerant connection pipe 6). The liquid-side shutoff valve 26 is provided at an end of the liquid refrigerant pipe 35. The gas-side shutoff valve 27 is provided at an end of the second gas refrigerant pipe 34. The liquid-side shutoff valve 26 and the gas-side shutoff valve 27 are manual valves that are opened and closed by hand.

(2-2-6) Outdoor Fan

The outdoor fan 36 plays a role of sucking outdoor air into the outdoor unit 2 to exchange heat with the refrigerant in the outdoor heat exchanger 23, and then discharging the air to the outside. The outdoor fan 36 is a propeller fan or the like driven by an outdoor fan motor 37. The outdoor fan motor 37 can change a frequency (number of revolutions) by an inverter.

(2-2-7) Various Sensors

The outdoor unit 2 includes various sensors. The outdoor unit 2 includes a suction temperature sensor 51, a discharge temperature sensor 52, an intermediate temperature sensor 53, a liquid pipe temperature sensor 54, and an outside air temperature sensor 55. The suction temperature sensor 51 detects a temperature Ts of the low-pressure refrigerant sucked into the compressor 21 in the refrigeration cycle. The discharge temperature sensor 52 detects a temperature Td of the high-pressure refrigerant discharged from the compressor 21 in the refrigeration cycle. The intermediate temperature sensor 53 detects a temperature Tom of the refrigerant in the intermediate portion of the outdoor heat exchanger 23. The liquid pipe temperature sensor 54 detects a temperature Tol of the refrigerant on the liquid side of the outdoor heat exchanger 23. The outside air temperature sensor 55 detects a temperature Toa of the outdoor air sucked into the outdoor unit 2.

(2-2-8) Accumulator

Figure 2:
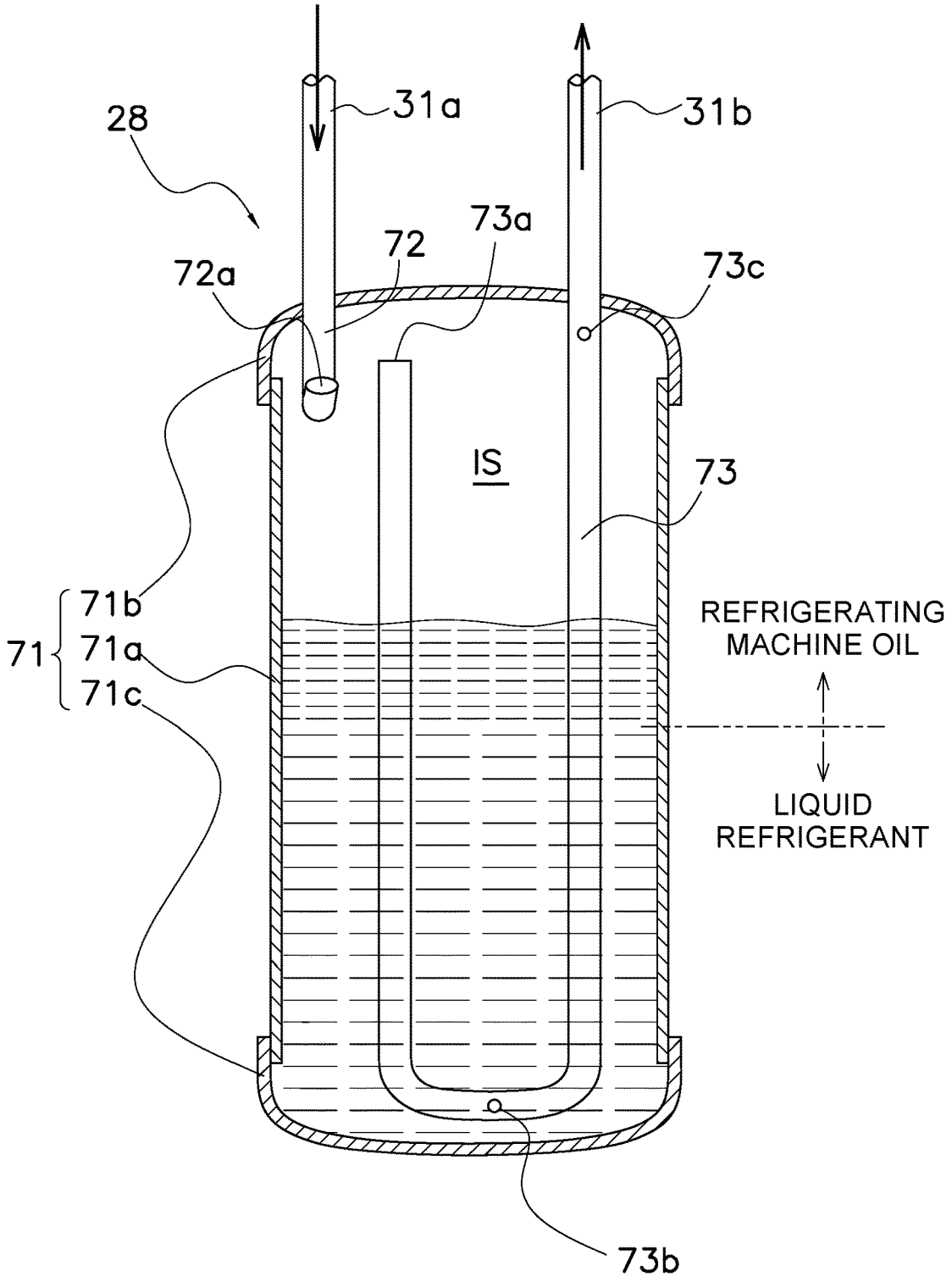
FIG. 2 is a schematic configuration diagram of an accumulator.

As described above, the accumulator 28 of the outdoor unit 2 is disposed between the suction side of the compressor 21 and the first port 22*a* of the four-way switching valve 22. The accumulator 28 has a function of separating the refrigerant into gas and liquid, and storing excess refrigerant on the suction side of the compressor 21. The accumulator 28 separates, into gas and liquid, the refrigerant returned from the indoor heat exchanger 41 or the outdoor heat exchanger 23 serving as an evaporator through the first pipe 31*a* of the suction pipe 31 connected to the four-way switching valve 22. Out of the refrigerant separated into gas and liquid, the gas refrigerant is sent to the compressor 21. As shown in FIG. 2, the accumulator 28 includes a casing 71 forming an internal space IS, an inlet pipe 72, and an outlet pipe 73.

The casing 71 mainly includes a cylindrical body 71*a*, a bowl-shaped upper lid 71*b* closing an opening above the body 71*a*, and a bowl-shaped lower lid 71*c* closing an opening below the body 71*a*. The inlet pipe 72 introduces the refrigerant that has passed through the first pipe 31*a* of the suction pipe 31 into the internal space IS. The inlet pipe 72 penetrates a periphery of the upper lid 71*b*. A tip opening 72*a* of the inlet pipe 72 is disposed in an upper portion of the internal space IS.

The outlet pipe 73 of the accumulator 70 guides the gas refrigerant separated in the internal space IS to the second pipe 31*b* of the suction pipe 31 connected to the compressor 21. The outlet pipe 73 is a J-shaped pipe. The outlet pipe 73 penetrates the upper lid 71*b* and makes a U-turn in a lower portion of the internal space IS. The height position of an opening 73*a* at an upper end (tip) of the outlet pipe 73 is located in an upper portion of the internal space IS. An oil return hole 73*b* is formed in the U-turn portion of the outlet pipe 73 in the lower portion of the internal space IS. The oil return hole 73*b* is provided to return the refrigerating machine oil accumulated together with the liquid refrigerant in the lower portion of the internal space IS of the casing 71 to the compressor 21. A pressure equalizing hole 73*c* is formed in a portion of the outlet pipe 73 near the upper lid 71*b*.

The outlet pipe 73 of the accumulator 70 is connected to the compressor 21 by the second pipe 31*b* of the suction pipe 31.

(3) Refrigerant Connection Pipe

The refrigerant connection pipes 5 and 6 are refrigerant pipes constructed on the spot when the air conditioning apparatus 1 is installed at an installation location such as a building. The length and pipe diameter of the refrigerant connection pipes 5 and 6 are selected according to installation conditions such as the installation location and a combination of the outdoor unit 2 and the indoor unit 4.

As described above, part of the refrigerant circuit 10 of the indoor unit 4 is connected to part of the refrigerant circuit 10 of the outdoor unit 2 by the refrigerant connection pipes 5 and 6, constituting the refrigerant circuit 10 as a whole. In the refrigerant circuit 10, mainly, the compressor 21, the outdoor heat exchanger 23 which functions as a radiator or evaporator for the refrigerant, the expansion valve 24, the indoor heat exchanger 41 which functions as an evaporator or radiator for the refrigerant, and the accumulator (container) 28 are connected in order.

(4) Control Configuration

Figure 3:
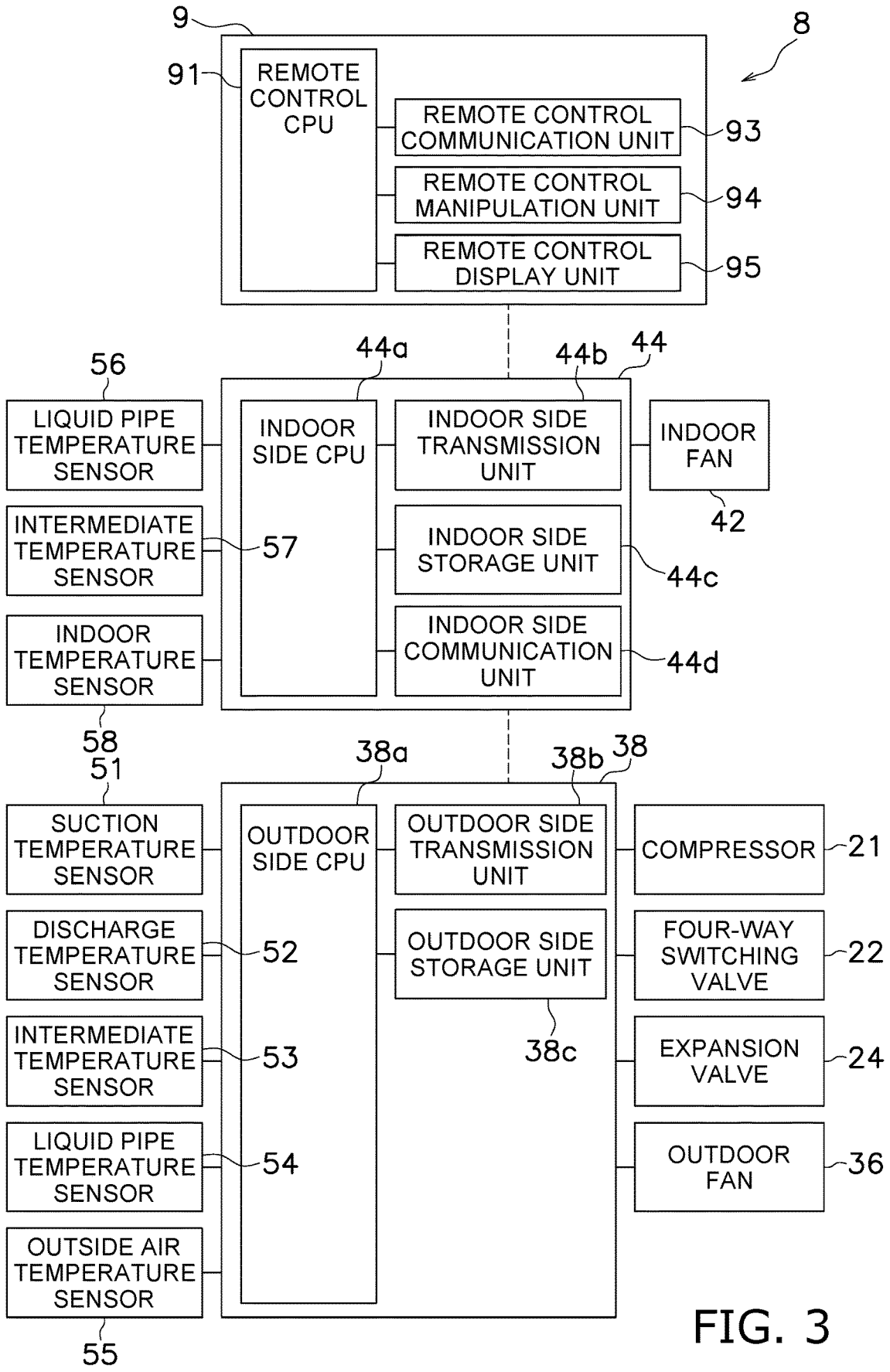
FIG. 3 is a control block diagram of the air conditioning apparatus.

FIG. 3 is a control block diagram of the air conditioning apparatus 1 (refrigeration apparatus). The air conditioning apparatus 1 includes a control unit 8 that controls constituent devices. The control unit 8 is configured by connecting an outdoor control unit 38, an indoor control unit 44, and a remote control device 9 via a transmission line or a communication line. The outdoor control unit 38 is provided in the outdoor unit 2. The indoor control unit 44 is provided in the indoor unit 4. The remote control device 9 is provided indoors. Here, the control units 38 and 44 and the remote control device 9 are connected by wire via a transmission line or a communication line, but may be wirelessly connected.

(4-1) Outdoor Control Unit

The outdoor control unit 38 is provided in the outdoor unit 2 as described above, and mainly includes an outdoor CPU 38*a*, an outdoor transmission unit 38*b*, and an outdoor storage unit 38*c*. The outdoor control unit 38 receives detection signals such as signals from the temperature sensors 51 to 55.

The outdoor CPU 38*a* is connected to the outdoor transmission unit 38*b* and the outdoor storage unit 38*c*. The outdoor transmission unit 38*b* transmits control data and the like to and from the indoor control unit 44. The outdoor storage unit 38*c* stores control data and the like. The outdoor CPU 38*a* controls constituent devices provided in the outdoor unit 2 (compressor 21, four-way switching valve 22, expansion valve 24, outdoor fan 36, and the like) while transmitting, reading, and writing control data and the like via the outdoor transmission unit 38*b* and the outdoor storage unit 38*c*.

(4-2) Indoor Control Unit

The indoor control unit 44 is provided in the indoor unit 4 as described above, and mainly includes an indoor CPU 44*a*, an indoor transmission unit 44*b*, an indoor storage unit 44*c*, and an indoor communication unit 44*d*. The indoor control unit 44 receives detection signals such as signals from the temperature sensors 56 to 58.

The indoor CPU 44*a* is connected to the indoor transmission unit 44*b*, the indoor storage unit 44*c*, and the indoor communication unit 44*d*. The indoor transmission unit 44*b* transmits control data and the like to and from the outdoor control unit 38. The indoor storage unit 44*c* stores control data and the like. The indoor communication unit 44*d* sends and receives control data and the like to and from the remote control device 9. The indoor CPU 44*a* controls constituent devices provided in the indoor unit 4 (indoor fan 42 and the like) while transmitting, reading, writing, sending, and receiving control data and the like via the indoor transmission unit 44*b*, the indoor storage unit 44*c*, and the indoor communication unit 44*d*.

(4-3) Remote Control Device

The remote control device 9 is provided indoors as described above, and mainly includes a remote control CPU 91, a remote control communication unit 93, a remote control manipulation unit 94, and a remote control display unit 95.

The remote control CPU 91 is connected to the remote control communication unit 93, the remote control manipulation unit 94, and the remote control display unit 95. The remote control communication unit 93 sends and receives control data and the like to and from the indoor communication unit 44*d*. The remote control manipulation unit 94 receives input such as a control command from a user. The remote control display unit 95 displays the operation and the like. The remote control CPU 91 receives input such as operation commands and control commands via the remote control manipulation unit 94, and issues control commands and the like to the indoor control unit 44 via the remote control communication unit 93 while displaying the operating state, control state, and the like on the remote control display unit 95.

(5) Basic Operation

Next, the basic operation of the air conditioning apparatus 1 (refrigeration apparatus) will be described with reference to FIGS. 1 and 3. As the basic operation, the air conditioning apparatus 1 executes the cooling operation and the heating operation.

(5-1) Cooling Operation

When a cooling operation command is received via the remote control manipulation unit 94 of the remote control device 9 or the like, the control unit 8 sets the operating mode of the air conditioning apparatus 1 to the cooling operation. Then, the control unit 8 switches the four-way switching valve 22 to the cooling cycle state (state shown by the solid line in FIG. 1), drives the compressor 21 and the fans 36 and 42, and opens the expansion valve 24.

Then, the low-pressure refrigerant in the refrigeration cycle in the refrigerant circuit 10 is sucked into the compressor 21, compressed to high pressure in the refrigeration cycle, and then discharged.

The high-pressure gas refrigerant discharged from the compressor 21 is sent to the outdoor heat exchanger 23 through the four-way switching valve 22.

The high-pressure gas refrigerant sent to the outdoor heat exchanger 23 radiates heat by heat exchange with outdoor air supplied as a cooling source by the outdoor fan 36 in the outdoor heat exchanger 23, and becomes a high-pressure liquid refrigerant.

The high-pressure liquid refrigerant that has radiated heat in the outdoor heat exchanger 23 is sent to the expansion valve 24. The high-pressure liquid refrigerant sent to the expansion valve 24 is decompressed by the expansion valve 24 to low pressure in the refrigeration cycle.

The low-pressure refrigerant decompressed in the expansion valve 24 is sent to the indoor heat exchanger 41 through the liquid-side shutoff valve 26 and the liquid-refrigerant connection pipe 5.

The low-pressure refrigerant sent to the indoor heat exchanger 41 exchanges heat with the indoor air supplied by the indoor fan 42 as a heating source to evaporate in the indoor heat exchanger 41. The indoor air is thus cooled and then supplied into the room, thereby cooling the room.

The low-pressure refrigerant evaporated in the indoor heat exchanger 41 is sent to the suction pipe 31 through the gas-refrigerant connection pipe 6, the gas-side shutoff valve 27, and the four-way switching valve 22. Thereafter, the refrigerant is sucked into the compressor 21 again through the accumulator 28.

(5-2) Heating Operation

When a heating operation command is received via the remote control manipulation unit 94 of the remote control device 9 or the like, the control unit 8 sets the operating mode of the air conditioning apparatus 1 to the heating operation. Then, the control unit 8 switches the four-way switching valve 22 to the heating cycle state (state shown by the broken line in FIG. 1), drives the compressor 21 and the fans 36 and 42, and opens the expansion valve 24.

Then, the low-pressure refrigerant in the refrigeration cycle in the refrigerant circuit 10 is sucked into the compressor 21, compressed to high pressure in the refrigeration cycle, and then discharged.

The high-pressure gas refrigerant discharged from the compressor 21 is sent to the indoor heat exchanger 41 via the four-way switching valve 22, the gas-side shutoff valve 27, and the gas-refrigerant connection pipe 6.

The high-pressure gas refrigerant sent to the indoor heat exchanger 41 radiates heat by heat exchange with indoor air supplied as a cooling source by the indoor fan 42 in the indoor heat exchanger 41, and becomes a high-pressure liquid refrigerant. The indoor air is thus heated and then supplied into the room, thereby heating the room.

The high-pressure liquid refrigerant that has radiated heat in the indoor heat exchanger 41 is sent to the expansion valve 24 through the liquid-refrigerant connection pipe 5 and the liquid-side shutoff valve 26.

The high-pressure liquid refrigerant sent to the expansion valve 24 is decompressed by the expansion valve 24 to low pressure in the refrigeration cycle. The low-pressure refrigerant decompressed in the expansion valve 24 is sent to the outdoor heat exchanger 23. The low-pressure liquid refrigerant sent to the outdoor heat exchanger 23 exchanges heat with the outdoor air supplied as a heating source by the outdoor fan 36 to evaporate in the outdoor heat exchanger 23.

The low-pressure refrigerant evaporated in the outdoor heat exchanger 23 is sent to the suction pipe 31 through the four-way switching valve 22, and sucked again into the compressor 21 through the accumulator 28.

(5-3) Basic Control

In the above-described basic operation (cooling operation and heating operation), the control unit 8 executes compressor capacity control and expansion valve degree of subcooling control as basic control.

(5-3-1) Compressor Capacity Control

The compressor capacity control is control to change the frequency F of the compressor 21 based on the temperature difference ΔTra between the indoor temperature Tra and the indoor set temperature Trat. The set temperature Trat is a temperature value set via the remote control manipulation unit 94 of the remote control device 9, or the like.

In the cooling operation, the control unit 8 obtains the temperature difference ΔTra by subtracting the set temperature Trat from the indoor temperature Tra. In the heating operation, the control unit 8 obtains the temperature difference ΔTra by subtracting the indoor temperature Tra from the set temperature Trat.

Since it is required to increase the air conditioning capacity (cooling capacity or heating capacity) as refrigerating capacity when the temperature difference ΔTra is positive (in other words, when the indoor temperature Tra does not reach the set temperature Trat), the control unit 8 increases the frequency F of the compressor 21. Specifically, the control unit 8 determines the change width ΔF of the frequency F of the compressor 21 according to the magnitude of the temperature difference ΔTra to increase the frequency F of the compressor 21 by the change width ΔF. Since it is required to decrease the air conditioning capacity (cooling capacity or heating capacity) when the temperature difference ΔTra is negative (in other words, when the indoor temperature Tra reaches the set temperature Trat), the control unit 8 decreases the frequency F of the compressor 21. Specifically, the control unit 8 determines the change width ΔF of the frequency F of the compressor 21 according to the magnitude of the temperature difference ΔTra to decrease the frequency F of the compressor 21 by the change width ΔF.

(5-3-2) Expansion Valve Degree of Subcooling Control

The expansion valve degree of subcooling control is control to change the opening degree MV of the expansion valve 24 based on the degree of subcooling SC of the refrigerant at an outlet of the radiator for the refrigerant. Specifically, the control unit 8 changes the opening degree MV of the expansion valve 24 such that the degree of subcooling SC becomes the target degree of subcooling SCt. The degree of subcooling SC is the degree of subcooling at the outlet of the outdoor heat exchanger 23 that functions as a radiator for the refrigerant in the cooling operation, and is the degree of subcooling at the outlet of the indoor heat exchanger 41 that functions as a radiator for the refrigerant in the heating operation.

In the cooling operation, the control unit 8 subtracts the refrigerant temperature Tol on the liquid side of the outdoor heat exchanger 23 from the refrigerant temperature Tom in the intermediate portion of the outdoor heat exchanger 23 to obtain the degree of subcooling SC. In the heating operation, the control unit 8 subtracts the temperature Trl from the temperature Trm of the indoor heat exchanger 41 to obtain the degree of subcooling SC.

When the degree of subcooling SC is greater than the target degree of subcooling SCt, the control unit 8 increases the opening degree MV of the expansion valve 24 in order to decrease the degree of subcooling SC. Specifically, the control unit 8 determines the change width ΔMV of the opening degree MV of the expansion valve 24 according to the degree of subcooling difference ΔSC between the degree of subcooling SC and the target degree of subcooling SCt, and increases the opening degree MV of the expansion valve 24 by the change width ΔMV. When the degree of subcooling SC is smaller than the target degree of subcooling SCt, the control unit 8 decreases the opening degree MV of the expansion valve 24 in order to increase the degree of subcooling SC. Specifically, the control unit 8 determines the change width ΔMV of the opening degree MV of the expansion valve 24 according to the degree of subcooling difference ΔSC between the target degree of subcooling SCt and the degree of subcooling SC, and decreases the opening degree MV of the expansion valve 24 by the change width ΔMV.

(5-4) Oil Return Control

The oil return control is control in an oil return operation for returning the refrigerating machine oil that has flowed out from the compressor 21 to the refrigerant circuit 10 (except compressor 21) to the compressor 21. In the oil return operation, the compressor 21 is driven at a predetermined number of oil return revolutions for a predetermined time.

Note that the predetermined number of oil return revolutions is required at least to be set to the number of revolutions at which the desired amount of refrigerating machine oil out of the refrigerating machine oil that has flowed out to the refrigerant circuit 10 except the compressor 21 returns to the compressor 21 by driving the compressor 21 for a predetermined time, and to be determined as appropriate by simulation, experiment, calculation on paper, or the like. The predetermined number of oil return revolutions is usually set to some relatively high number of revolutions. This is to efficiently return the refrigerating machine oil in the refrigerant circuit 10 to the compressor 21.

When the condition that the amount of refrigerant circulating in the refrigerant circuit 10 exceeds a threshold value is satisfied, the amount being integrated after the previous oil return operation, the control unit 8 executes the oil return operation. The threshold value of the integrated value of the refrigerant is set near the upper limit of the amount of discharged oil allowed for reliability of the compressor 21.

(5-5) Separation Solution Control to Solve the Separation State of the Refrigerant and the Refrigerating Machine Oil in the Accumulator Since the air conditioning apparatus 1 uses difluoromethane (R32) as a refrigerant, when the outside air temperature is low, the degree of miscibility between the refrigerant and the refrigerating machine oil, which is sealed with the refrigerant for lubrication of the compressor 21, is very small. Therefore, on the low-pressure side in the refrigeration cycle, because of a decrease in the refrigerant temperature, the degree of miscibility between the refrigerating machine oil and the refrigerant greatly decreases. The refrigerant and the refrigerating machine oil are separated into two layers in the accumulator 28 that becomes low pressure in the refrigeration cycle, and it becomes difficult for the refrigerating machine oil to return to the compressor 21. For example, in the heating operation when the outside air temperature is low, as shown in FIG. 2, the lower portion of the internal space IS of the casing 71 tends to be filled with the liquid refrigerant and the refrigerating machine oil separated from the liquid refrigerant tends to gather in the upper portion of the internal space IS. Then, the oil return hole 73*b* of the outlet pipe 73 of the accumulator 28 is separated from the refrigerating machine oil, and therefore the refrigerating machine oil that has accumulated in the internal space IS of the accumulator 28 cannot be returned to the compressor 21. In other words, since the amount of liquid refrigerant increases around the oil return hole 73*b* of the outlet pipe 73, the amount of refrigerating machine oil sucked from the oil return hole 73*b* decreases, and a sufficient amount of refrigerating machine oil cannot be returned to the compressor 21.

(5-5-1) Separation Solution Control Including Separation Solution Operation

In view of this, when the refrigerant and the refrigerating machine oil are separated in the accumulator 28, the control unit 8 executes a separation solution operation to solve the separation state. Hereinafter, the separation solution control including the separation solution operation will be described with reference to the control flowchart shown in FIG. 4.

In step S1, the control unit 8 determines whether there is an operation stop signal. The operation stop signal is a signal sent from the remote control device 9 to the indoor control unit 44 when a manipulation of stopping the operation of the air conditioning apparatus 1 is executed with the remote control manipulation unit 94 of the remote control device 9. The operation stop signal is, for example, a thermo-off signal sent from the indoor control unit 44 to the outdoor control unit 38 when the room temperature becomes higher than the indoor heating set temperature by 1° C. or more.

On determination in step S1 that there is an operation stop signal, the process proceeds to step S12, and the control unit 8 determines whether the suction temperature Ts is lower than a first threshold temperature T1. The suction temperature Ts is a temperature of the refrigerant in front of the accumulator 28, the temperature being detected by the suction temperature sensor 51.

On determination in step S12 that the suction temperature Ts is equal to or higher than the first threshold temperature T1, the degree of separation between the refrigerant and the refrigerating machine oil in the accumulator 28 is within a permissible range while the compressor is stopped, and the control unit 8 stops the compressor 21 as it is (step S13).

On determination in step S1 that there is no operation stop signal, the process proceeds to step S2, and the control unit 8 determines whether the suction temperature Ts is lower than a second threshold temperature T2.

On determination in step S2 that the suction temperature Ts is equal to or higher than the second threshold temperature T2, the degree of separation between the refrigerant and the refrigerating machine oil in the accumulator 28 is within the permissible range while the compressor is operating, and thus the control unit 8 maintains normal control of the number of revolutions of the compressor 21 and control of the opening degree of the expansion valve 24 at that time, and returns to step S1.

Note that regarding the degree of separation between the refrigerant and the refrigerating machine oil in the accumulator 28, the permissible range while the compressor is stopped is different from the permissible range while the compressor is operating. Since it is preferable to continue normal control as much as possible while the compressor is operating, the permissible range while the compressor is operating is set widely. The permissible range while the compressor is stopped is set narrower than the permissible range while the compressor is operating in order to ensure that the refrigerating machine oil in the compressor 21 is sufficient when restarting the compressor 21. Therefore, the second threshold temperature T2 is lower than the first threshold temperature T1.

On determination in step S2 that the suction temperature Ts is below the second threshold temperature T2 or on determination in step S12 that the suction temperature Ts is below the first threshold temperature T1, the control unit 8 proceeds to steps S3 and S4. In steps S3 and S4, in order to alleviate and solve the separation state between the refrigerant and the refrigerating machine oil in the accumulator 28, the number of revolutions of the compressor 21 is decreased to a predetermined number of revolutions, and the opening degree of the expansion valve 24 is increased until fully opened. The control unit 8 executes each of the operations of steps S3 and S4 in parallel.

Thereafter, after waiting for a certain period of time (step S5), the process proceeds to step S6, and the control unit 8 returns to normal control before executing steps S3 and S4 by which the opening degree of the expansion valve 24 and the number of revolutions of the compressor 21 are adjusted. The number of revolutions of the compressor 21 and the opening degree of the expansion valve 24 in normal control are determined as described in (5-3-1) and (5-3-2).

Note that the certain period of time in step S5 can be selected from the range from 1 minute to 10 minutes, and is set in advance when the air conditioning apparatus 1 is manufactured.

As described above, the control unit 8 determines whether the refrigerant and the refrigerating machine oil are separated in the accumulator 28 based on the temperature Ts detected by the suction temperature sensor 51 (steps S2 and S12). Then, when it is detected that the refrigerant and the refrigerating machine oil are separated in the accumulator 28, the control unit 8 executes the separation solution operation (steps S3, S4, S5). In the separation solution operation, the compressor 21 is driven at a predetermined number of revolutions lower than in the oil return operation. Accordingly, the separation state of the refrigerant and the refrigerating machine oil in the internal space IS of the accumulator 28 is alleviated and solved.

(5-5-2) Determination of Degree of Separation Between Refrigerant and Refrigerating Machine Oil in Accumulator In steps S12 and S2, it is determined whether the refrigerant and the refrigerating machine oil are separated in the accumulator 28 by using respective threshold values (first threshold temperature T1 and second threshold temperature T2). This determination is made by the control unit 8 based on the temperature inside the accumulator 28, here, the suction temperature Ts corresponding to the temperature.

Figure 5:
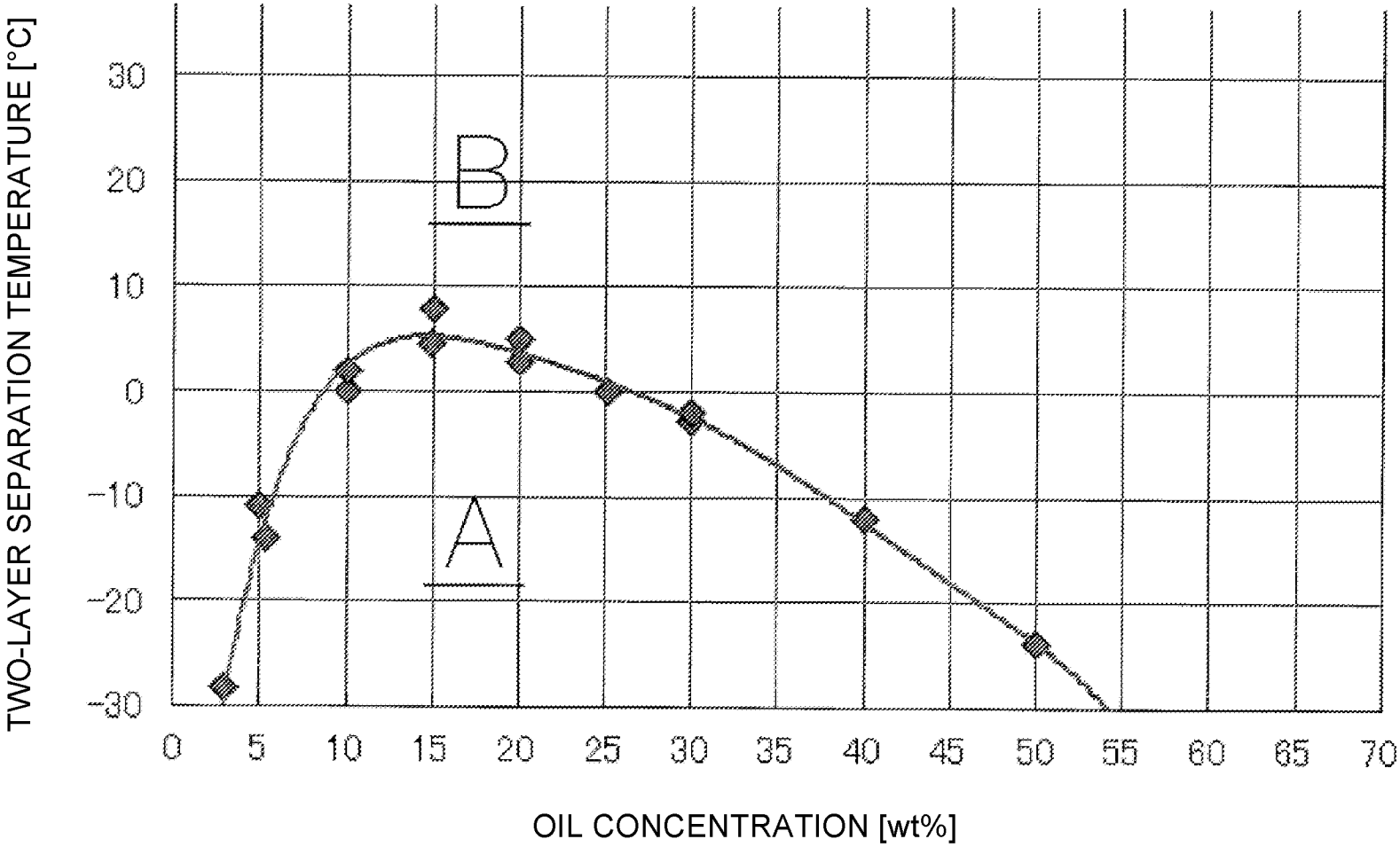
FIG. 5 is a graph showing the relationship between oil concentration and a two-layer separation temperature.

The control unit 8 determines whether the refrigerant and the refrigerating machine oil are separated in the accumulator 28 with reference to the graph shown in FIG. 5. The graph shown in FIG. 5 is divided into a region A in an environment where the refrigerant and the refrigerating machine oil are separated, and a region B in an environment where the refrigerant and the refrigerating machine oil are not separated. The graph shown in FIG. 5 is a graph showing the relationship between oil concentration and two-layer separation temperature when the refrigerant is difluoromethane (R32) and the refrigerating machine oil is polyvinyl ether (PVE). For example, when the oil concentration is 25 wt %, the two-layer separation temperature is about 0° C. and each threshold value is set near 0° C. For example, the second threshold temperature T2 is set to −3° C. and the first threshold temperature T1 is set to 0° C.

Note that in the separation solution operation, a decrease in the number of revolutions of the compressor 21 and an increase in the opening degree of the expansion valve 24 lead to an increase in the pressure in the accumulator 28 and an increase in the temperature of the refrigerant. With this configuration, even if the refrigerant and the refrigerating machine oil are separated in the accumulator 28, the temperature of the refrigerant increases to exceed the two-layer separation temperature shown in FIG. 5, alleviating and solving the separation state.

(6) Features

Next, features of the air conditioning apparatus 1 (refrigeration apparatus) will be described.

(6-1)

In the air conditioning apparatus 1, the suction temperature sensor 51 detects the temperature of the refrigerant flowing into the accumulator 28. The control unit 8 controls the number of revolutions of the compressor 21 and the opening degree of the expansion valve 24. On determination that the refrigerant and the refrigerating machine oil (lubricating oil) are separated inside the accumulator 28 based on the detection result of the suction temperature sensor 51, the control unit 8 executes the separation solution operation including steps S3 and S4. In the control of step S3, the number of revolutions of the compressor 21 is decreased. In the control of step S4, the opening degree of the expansion valve 24 is set to the predetermined opening degree (fully open).

Here, the separation solution operation of decreasing the number of revolutions of the compressor 21 and increasing the opening degree of the expansion valve 24 is executed when the refrigerant and the refrigerating machine oil are separated inside the accumulator 28. Therefore, the pressure (low pressure value) on the suction side of the compressor 21 including the accumulator 28 can be increased. This makes it possible to change the pressure and temperature in the accumulator 28 to solve the separation state between the refrigerant and the refrigerating machine oil.

(6-2)

In the air conditioning apparatus 1, the control unit 8 fully opens the opening degree of the expansion valve 24 in the control of step S4. Therefore, since the separation solution operation is executed to fully open the opening degree of the expansion valve 24 when the refrigerant and the refrigerating machine oil are separated inside the accumulator 28, a large amount of high-temperature refrigerant flows into the accumulator 28. This allows the separation solution operation to solve the separation state between the refrigerant and the refrigerating machine oil at an early stage.

(6-3)

In the air conditioning apparatus 1, the control unit 8 decreases the number of revolutions of the compressor 21 in the control of step S3 to set the number of revolutions of the compressor 21 to a predetermined number of revolutions. Here, the control to decrease the number of revolutions of the compressor 21 to the predetermined number of revolutions is adopted instead of the control to decrease the number of revolutions a little. Therefore, the separation state between the refrigerant and the refrigerating machine oil is solved in a short time. Note that as one example, in the control of step S3, the number of revolutions of the compressor 21 is decreased to a predetermined number of revolutions in the range from 20 to 30 rpm.

(6-4)

In the air conditioning apparatus 1, the control unit 8 executes the oil return operation separately from the separation solution operation. As described above, the oil return operation is an operation of returning the refrigerating machine oil staying in the refrigerant circuit 10 except the compressor 21 to the compressor 21.

Some conventional refrigeration apparatus, such as the air conditioning apparatus, also executes the oil return operation similar to the present embodiment. However, the oil return operation, in which the motor of the compressor is turned at a relatively high number of revolutions, may not be preferable as an operation to solve the separation state between the refrigerant and the refrigerating machine oil inside the container such as the accumulator. Therefore, the control unit 8 of the air conditioning apparatus 1 executes the separation solution operation shown in FIG. 4, in addition to the oil return operation, to alleviate and solve the separation between the refrigerant and the refrigerating machine oil in the accumulator 28.

Note that, in contrast to the oil return operation of turning the compressor 21 at a relatively high number of revolutions, in the separation solution operation to solve the separation between the refrigerant and the refrigerating machine oil in the accumulator 28, the number of revolutions of the compressor 21 is decreased to the predetermined number of revolutions. Since the compressor 21 is turned at a lower number of revolutions (predetermined number of revolutions) unlike the oil return operation, the pressure in the accumulator 28 increases and the separation state between the refrigerant and the refrigerating machine oil in the accumulator 28 is alleviated and solved at an early stage.

(6-5)

Figure 4:
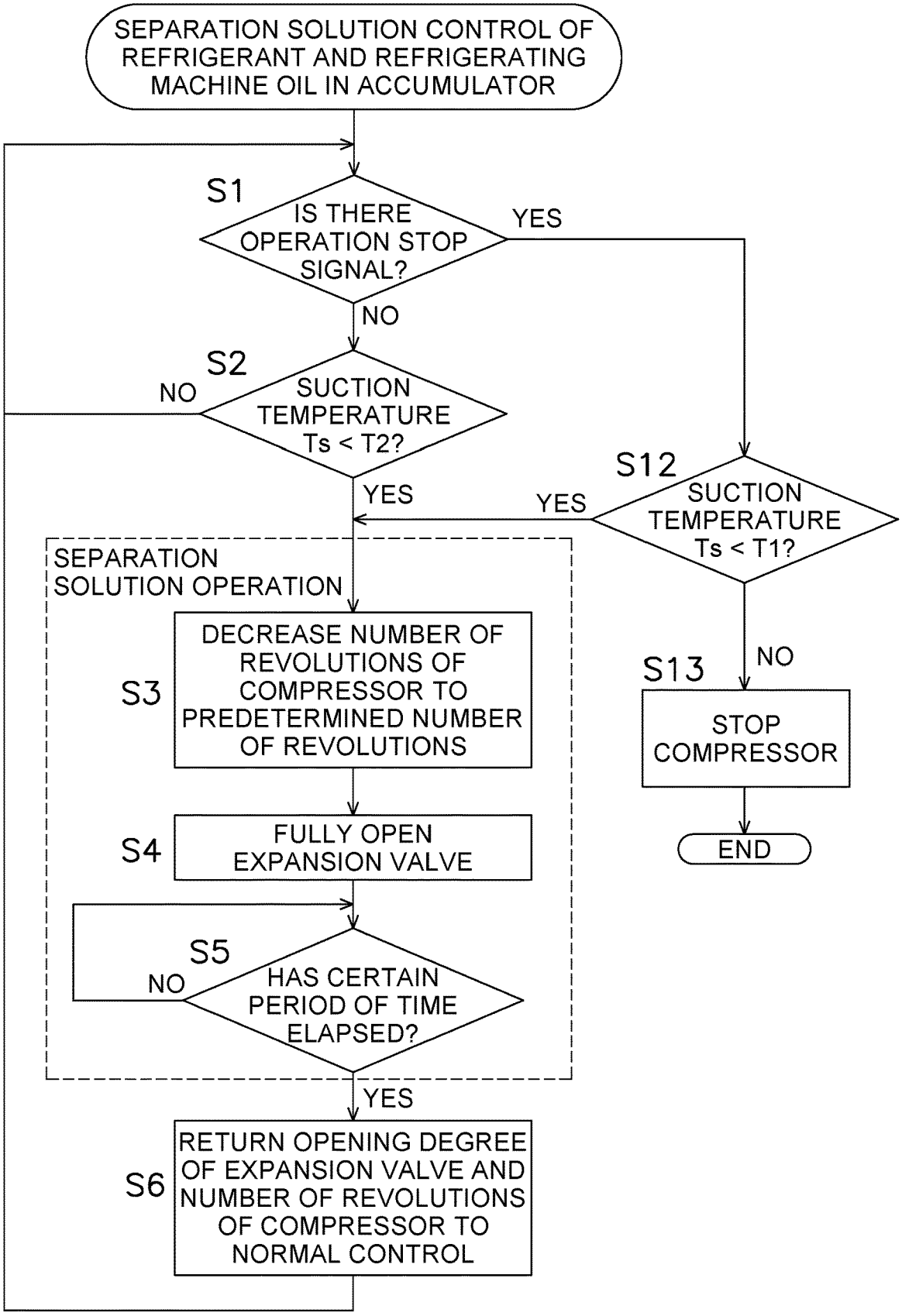
FIG. 4 is a flowchart of separation solution control of a refrigerant and refrigerating machine oil in the accumulator.

In the air conditioning apparatus 1, when the request to stop the compressor 21 is received, the control unit 8 determines whether to execute the separation solution operation before stopping the compressor 21, based on the detection result of the suction temperature sensor 51 (see step S12 in FIG. 4). If the suction temperature Ts is so low that stopping the compressor 21 as it is may lead to a situation where the refrigerating machine oil in the compressor 21 is insufficient when restarting, control is executed to stop the compressor (step S13 in FIG. 4) after the separation solution operation is executed. When the suction temperature Ts is lower than the first threshold temperature T1 in step S12 and the separation solution operation is performed, the suction temperature Ts increases accordingly. When the determination is made again in step S12 after the separation solution operation is finished, it is determined in step S12 that the suction temperature Ts is higher than the first threshold temperature T1, and the process proceeds to step S13 to stop the compressor 21.

Here, the situation in which the compressor 21 is stopped while the refrigerant and the refrigerating machine oil are separated in the accumulator 28 and the compressor 21 runs out of refrigerating machine oil when the compressor 21 is started again is inhibited.

(6-6)

In the air conditioning apparatus 1, when the request to stop the compressor 21 is received, the control unit 8 determines whether the refrigerant and the refrigerating machine oil are separated inside the accumulator 28 by a first criterion (first threshold temperature T1) based on the detection result of the suction temperature sensor 51. Meanwhile, when the request to stop the compressor 21 is not received, the control unit 8 determines whether the refrigerant and the refrigerating machine oil are separated inside the accumulator 28 by a second criterion (second threshold temperature T2) different from the first criterion (first threshold temperature T1) based on the detection result of the suction temperature sensor 51.

Here, both when the request to stop the compressor 21 is received and not received, it is determined whether the refrigerant and the refrigerating machine oil are separated inside the accumulator 28. Therefore, both when the compressor 21 is operating and when the compressor 21 is stopped, the separation solution operation for solving the separation state between the refrigerant and the refrigerating machine oil can be executed. The criterion for determining whether the refrigerant and the refrigerating machine oil are separated inside the accumulator 28 is changed depending on whether the request to stop the compressor 21 is received or not. This makes it possible, for example, to decrease the frequency at which the first and second control is executed when the compressor 21 is operating, and to increase the frequency at which the first and second control is executed when the compressor 21 stops.

(7) Modifications (7-1)

The embodiment determines the degree of separation between the refrigerant and the refrigerating machine oil in the accumulator 28 by using the measured value of the suction temperature sensor 51 that detects the temperature of the refrigerant flowing into the accumulator 28.

However, instead of this, it is also possible to install a sensor that can directly measure the temperature inside the accumulator 28 and use the measured value of the sensor.

It is also possible to attach a temperature sensor to the outer peripheral surface of the accumulator 28, or to attach a temperature sensor to a pipe downstream of the accumulator 28.

Furthermore, it is possible to install a pressure sensor that measures the pressure of the refrigerant in the accumulator 28 or around the accumulator 28 instead of the temperature sensor, and to calculate the temperature of the refrigerant in the accumulator 28 from the measured value.

Instead of determining the degree of separation of the refrigerant and refrigerating machine oil in the accumulator 28 from the measured values of one sensor alone, the separation may be determined based on a plurality of parameters such as the measured value of the suction temperature sensor 51 and the evaporation temperature.

(7-2)

The air conditioning apparatus 1 of the embodiment is an air conditioning apparatus that can switch between the cooling operation and the heating operation, but is not limited to this apparatus. The above-described separation solution operation is also effective for an air conditioning apparatus that executes only the cooling operation. When the refrigerant and the refrigerating machine oil are separated in the accumulator 28 in both the cooling operation and the heating operation, the separation solution operation is effective.

(7-3)

In the embodiment, the expansion valve 24 is fully opened in the separation solution operation (step S4 in FIG. 4), but is not necessarily required to be fully opened. This is because when the expansion valve 24 is fully opened, there is a disadvantage that it takes a little time to return to normal control after the separation solution operation. However, the opening degree of the expansion valve 24 in the separation solution operation is preferably 90% or more of the fully open position. This is because the liquid refrigerant held inside the heat exchanger by the expansion valve degree of subcooling control finally flows into the accumulator 28.

(7-4)

The embodiment has described the air conditioning apparatus 1 that uses difluoromethane (R32) alone as a refrigerant. However, even if a mixed refrigerant containing difluoromethane is used, the above-described separation solution operation is effective as long as the mixed refrigerant separates from the refrigerating machine oil when the temperature is low. Even if a refrigerant that does not contain difluoromethane is used, the above-described separation solution operation is effective as long as the mixed refrigerant separates from the refrigerating machine oil when the temperature is low.

(7-5)

The embodiment of the present disclosure has been described above. It will be understood that various changes to modes and details can be made without departing from the spirit and scope of the present disclosure recited in the claims.

REFERENCE SIGNS LIST

1: air conditioning apparatus (refrigeration apparatus)
8: control unit
10: refrigerant circuit
21: compressor
23: outdoor heat exchanger
24: expansion valve
28: accumulator (container)
41: indoor heat exchanger
51: suction temperature sensor (detection unit)
S3: control step of separation solution operation (first control)
S4: control step of separation solution operation (second control)

CITATION LIST

Patent Literature

Patent Literature 1: JP 2016-211774 A

The invention claimed is:

1. A refrigeration apparatus comprising:

a refrigerant circuit in which a compressor, a radiator, an expansion valve, an evaporator, and a container are connected in order, and a refrigerant flows therein;

a remote controller, configured to be operated by a user, that generates a request to stop the compressor;

a detector configured to detect a temperature or pressure of the refrigerant; and a controller configured to control a number of revolutions of the compressor and an opening degree of the expansion valve, wherein upon receipt of the request to stop the compressor, the controller determines whether the refrigerant and a lubricating oil are separated inside the container based on a detection result of the detector, and when the refrigerant and the lubricating oil are determined to be separated, the controller executes first control to decrease the number of revolutions of the compressor, executes second control to set the opening degree of the expansion valve to a predetermined opening degree, and thereafter, maintains the decreased number of revolutions of the compressor and set opening degree of the expansion valve for a predetermined period.

2. The refrigeration apparatus according to claim 1, wherein in the second control, the controller sets the opening degree of the expansion valve to an opening degree of a fully open position or 90% or more of the fully open position.

3. The refrigeration apparatus according to claim 1, wherein in the first control, the controller decreases the number of revolutions of the compressor to set the number of revolutions of the compressor to a predetermined number of revolutions.

4. The refrigeration apparatus according to claim 3, wherein the controller has an oil return operation to return the lubricating oil staying in the refrigerant circuit, except the lubricating oil in the compressor, to the compressor.

5. The refrigeration apparatus according to claim 4, wherein when a condition that an integrated value of an amount of the refrigerant circulating in the refrigerant circuit exceeds a threshold value is satisfied, the threshold value being set in a vicinity of an upper limit of the amount of discharged oil allowed for a reliability of the compressor, the controller executes the oil return operation.

6. The refrigeration apparatus according to claim 4, wherein the predetermined number of revolutions in the first control is smaller than the number of revolutions of the compressor in the oil return operation.

7. The refrigeration apparatus according to claim 1, wherein when the request to stop the compressor is received, the controller determines whether to execute the first control and the second control before stopping the compressor based on the detection result of the detector.

8. The refrigeration apparatus according to claim 1, wherein when the request to stop the compressor is received, the controller determines whether the refrigerant and the lubricating oil are separated inside the container by a first criterion based on the detection result of the detector, and when the request to stop the compressor is not received, the controller determines whether the refrigerant and the lubricating oil are separated inside the container by a second criterion different from the first criterion based on the detection result of the detector.

9. The refrigeration apparatus according to claim 1, wherein the detector includes a sensor configured to measure a temperature of the refrigerant in the container or a temperature of the refrigerant flowing through a refrigerant pipe connected to the container.

10. The refrigeration apparatus according to claim 1, wherein the refrigerant circulating through the refrigerant circuit is R32.

11. The refrigeration apparatus according to claim 1, wherein on determination that the refrigerant and the lubricating oil are separated inside the container from the detection result of the detector, the controller executes the first control and the second control to keep operating the compressor for the predetermined period from 1 minute to 10 minutes.

12. The refrigeration apparatus according to claim 2, wherein in the first control, the controller decreases the number of revolutions of the compressor to set the number of revolutions of the compressor to a predetermined number of revolutions.

13. The refrigeration apparatus according to claim 5, wherein the predetermined number of revolutions in the first control is smaller than the number of revolutions of the compressor in the oil return operation.

14. The refrigeration apparatus according to claim 2, wherein when the request to stop the compressor is received, the controller determines whether to execute the first control and the second control before stopping the compressor based on the detection result of the detector.

15. The refrigeration apparatus according to claim 3, wherein when the request to stop the compressor is received, the controller determines whether to execute the first control and the second control before stopping the compressor based on the detection result of the detector.

16. The refrigeration apparatus according to claim 4, wherein when the request to stop the compressor is received, the controller determines whether to execute the first control and the second control before stopping the compressor based on the detection result of the detector.

17. The refrigeration apparatus according to claim 5, wherein when the request to stop the compressor is received, the controller determines whether to execute the first control and the second control before stopping the compressor based on the detection result of the detector.

18. The refrigeration apparatus according to claim 6, wherein when the request to stop the compressor is received, the controller determines whether to execute the first control and the second control before stopping the compressor based on the detection result of the detector.

19. The refrigeration apparatus according to claim 2, wherein when the request to stop the compressor is received, the controller determines whether the refrigerant and the lubricating oil are separated inside the container by a first criterion based on the detection result of the detector, and when the request to stop the compressor is not received, the controller determines whether the refrigerant and the lubricating oil are separated inside the container by a second criterion different from the first criterion based on the detection result of the detector.

20. The refrigeration apparatus according to claim 3, wherein when the request to stop the compressor is received, the controller determines whether the refrigerant and the lubricating oil are separated inside the container by a first criterion based on the detection result of the detector, and when the request to stop the compressor is not received, the controller determines whether the refrigerant and the lubricating oil are separated inside the container by a second criterion different from the first criterion based on the detection result of the detector.

21. The refrigeration apparatus according to claim 1, wherein on determination that the refrigerant and the lubricating oil are separated inside the container based on a detection result of the detector, the controller maintains the first control and the second control for the predetermined period of 1 minute.

22. The refrigeration apparatus according to claim 1, wherein on determination that the refrigerant and the lubricating oil are separated inside the container based on a detection result of the detector, the controller maintains the first control and the second control for the predetermined period being set in advance.

* * * * *